US009446280B2

(12) United States Patent
Feinman et al.

(10) Patent No.: US 9,446,280 B2
(45) Date of Patent: Sep. 20, 2016

(54) APPARATUS FOR RESISTANCE-BASED FITNESS TRAINING

(71) Applicant: Matthew Feinman, New York, NY (US)

(72) Inventors: Matthew Feinman, New York, NY (US); Carl Jonas Peter Schonning, Jacksonville, FL (US); Henrik Georg Stahre, Jacksonville, FL (US)

(73) Assignee: Matthew Feinman, Syosset, NY (US)

( * ) Notice: Subject to any disclaimer, the term of this patent is extended or adjusted under 35 U.S.C. 154(b) by 143 days.

(21) Appl. No.: 14/162,882

(22) Filed: Jan. 24, 2014

(65) Prior Publication Data

US 2015/0080196 A1 Mar. 19, 2015

Related U.S. Application Data

(60) Provisional application No. 61/877,721, filed on Sep. 13, 2013.

(51) Int. Cl.
*A63B 69/20* (2006.01)
*A63B 69/30* (2006.01)
(Continued)

(52) U.S. Cl.
CPC ..... *A63B 21/0557* (2013.01); *A63B 21/0609* (2013.01); *A63B 21/065* (2013.01);
(Continued)

(58) Field of Classification Search
CPC ..... A63B 21/0557; A63B 21/0609; A63B 21/00189; A63B 21/06; A63B 21/0601; A63B 21/072; A63B 2021/0722; A63B 2021/0724–2021/0728; A63B 21/0615; A63B 21/151
USPC ..... 403/81, 82, 104, 83, 86, 89, 99
See application file for complete search history.

(56) References Cited

U.S. PATENT DOCUMENTS 1,814,356 A * 7/1931 Wise ..... 70/15
1,982,808 A * 12/1934 Hendersen ..... 473/143
(Continued)

FOREIGN PATENT DOCUMENTS

EP 2055356 A1 5/2009

OTHER PUBLICATIONS

Torq Tuf™ MEGAFLEX-121 3/8" Drive Advanced Ratchet Wrench System. http://www.torqtuf.com/product.aspx?product=megaflex and related pictures in that webpage (Accessed Jan. 15, 2014).
(Continued)

*Primary Examiner* — Oren Ginsberg
*Assistant Examiner* — Nyca T Nguyen
(74) *Attorney, Agent, or Firm* — Koffsky Schwalb LLC; Mark I. Koffsky

(57) ABSTRACT

An improved resistance-based fitness apparatus which may be transformed in multiple temporary yet stable shapes by the user, such that the all or some apparatus subsections may move freely be immobilized in a fixed position or manipulated by the user into various shapes. An improved joint-based connector apparatus which may enable the improved resistance-based fitness apparatus to be transformed into multiple temporary yet stable shapes with subsections that are either freely moving, immobilized in a fixed position, or a combination thereof. This improved joint may connect one or more objects while also providing for three-dimensional non-coplanar movement that may be selectively locked or unlocked at a variety of angles by a single activating action (e.g., pressing a button). The improved joint may also be fashioned into useful devices in various other arts beyond the fitness arts.

8 Claims, 12 Drawing Sheets

(51) Int. Cl.

| | |
|---|---|
| ***A63B 21/072*** | (2006.01) |
| ***A63B 21/075*** | (2006.01) |
| ***A63B 21/055*** | (2006.01) |
| ***A63B 21/06*** | (2006.01) |
| *A63B 21/065* | (2006.01) |

(52) U.S. Cl.

CPC ..... *A63B 21/072* (2013.01); *A63B 21/0724* (2013.01); *A63B 21/0726* (2013.01); *A63B 21/4001* (2015.10); *A63B 21/4039* (2015.10)

(56) References Cited

U.S. PATENT DOCUMENTS

| | | | | |
|---|---|---|---|---|
| 3,643,292 | A | 2/1972 | Mayer | |
| 4,271,663 | A * | 6/1981 | Templin et al. | 59/84 |
| 4,347,720 | A * | 9/1982 | Kenyon | 70/14 |
| 4,566,150 | A | 1/1986 | Boothe | |
| 5,110,315 | A | 5/1992 | Zawitz | |
| 5,157,912 | A * | 10/1992 | Yoshiga et al. | 59/78 |
| 5,938,573 | A | 8/1999 | Davies, III et al. | |
| 5,989,166 | A * | 11/1999 | Capizzo et al. | 482/104 |
| 6,364,799 | B1 * | 4/2002 | Campagnolo | 474/206 |
| 6,382,058 | B1 | 5/2002 | Owoc | |
| 6,557,442 | B1 | 5/2003 | Owoc | |
| 7,311,642 | B2 | 12/2007 | Li et al. | |
| 7,354,330 | B2 * | 4/2008 | Bentley, Jr. | A44C 13/00 446/102 |
| 7,424,933 | B2 | 9/2008 | Weiss | |
| 2005/0113221 | A1 | 5/2005 | Dovner et al. | |
| 2006/0123856 | A1 * | 6/2006 | Loughlin et al. | 70/18 |
| 2009/0156374 | A1 * | 6/2009 | Miyahira | 482/106 |
| 2009/0248202 | A1 * | 10/2009 | Osuka | A61B 1/0055 700/245 |
| 2012/0245003 | A1 | 9/2012 | Mirchev et al. | |
| 2012/0277074 | A1 | 11/2012 | Zeldakov | |

OTHER PUBLICATIONS

GearWrench 48" Extendable Indexing Pry Bar http://www.gearwrench.com/gearwrench-82248-48-extendable-indexing-pry-bar.html (Accessed Jan. 15, 2014).

YouTube Video for GearWrench® Indexing Pry Bar [82300, 82301, 82216, 82208, 82210, 82224, 82233, 82220, 82248] http://www.youtube.com/watch?v=Ebn0JcwVzG4&desktop_uri=%Fwatch%3Fv%3DEbn0JcwVzG4&app=desktop (Accessed Jan. 15, 2014).

Indexing Pry Bars come in 8, 10, 16, 24, and 33 in. lengths. http://news.thomasnet.com/fullstory/Indexing-Pry-Bars-come-in-8-10-16-24-and-33-in-lengths-818805 (Accessed Jan. 15, 2014).

International Search Report, PCT/US2014/054627, Dec. 23, 2014.

* cited by examiner

APPARATUS FOR RESISTANCE-BASED FITNESS TRAINING

RELATED APPLICATION

This application claims the benefit of U.S. Provisional Patent Application Ser. No. 61/877,721, filed on Sep. 13, 2013.

FIELD OF THE DISCLOSURE

The present disclosure relates generally to an improved apparatus used for resistance-based fitness training. The present disclosure also relates to an improved joint connector apparatus which may be used to construct the improved fitness apparatus. This improved joint connector apparatus may also be usefully configured in various other arts, beyond fitness training.

BACKGROUND

Traditional resistance-based fitness training apparatuses (such as dumbbells, kettlebells, barbells, medicine balls and other free weight devices used for resistance-based fitness training) are well-known in the art. But the usefulness of traditional resistance-based fitness training devices are limited because they are of a singular fixed shape and do not have subsections that can be made by the user to either be freely moving or locked in a fixed position so that the user can manipulate the apparatus into various different shapes with subsections either freely moving, locked in a fixed position or a combination thereof. Because there is no way for users to transform traditional resistance-based fitness training apparatuses into various temporary yet stable shapes with subsections that are either freely moving, locked in a fixed position, or a combination thereof, multiple different resistance-based fitness training apparatuses are often necessary, desirable or beneficial to the execution of the multitude of exercises that may be performed as part of an exercise regimen.

Further, the singular fixed shape of traditional resistance-based fitness training apparatuses often places undue stress on the user's joints and makes the user more prone to acute or overuse injury as a result of performing certain exercises with traditional resistance-based fitness training apparatuses that cannot be manipulated into shapes and configurations that may be better ergonomically suited for the safe and effective performance of a particular workout movement.

The ability to transform the shape and configuration (with subsections that could be made to be either freely moving or locked in a fixed position, or a combination thereof) of a resistance-based training device is desired because the range and type of exercises that may be performed with such an improved resistance-based fitness apparatus may be significantly greater than that which may be performed with traditional resistance-based training devices.

Thus, a single fitness apparatus that can be transformed into various shapes and configurations may be used to perform exercises traditionally performed with:

A. a barbell (by immobilizing all of the apparatus subsections in a straight fixed position);

B. dumbbells (by immobilizing the middle subsection(s) in a fixed position and configuring the end subsections in a freely moving position so that the user may incorporate arm/forearm/wrist supination into the exercise movement—a desired aspect of dumbbell use.);

C. a kettlebell (by immobilizing certain subsections in a compact fixed shape with more of the weight distributed at the bottom of the shape);

D. a chain (by leaving all of the subsections in a freely moving position);

E. a medicine ball (by immobilizing the subsections in a fixed circle- or square-like shape); and F. other apparatuses traditionally used for resistance-based fitness training.

This means that while multiple traditional resistance-based fitness resistance devices may be necessary, desirable or beneficial to the execution of the various exercises in a particular workout regimen, the improved resistance-based fitness apparatus described herein may allow the user to execute those same various exercises using instead only the improved resistance-based fitness apparatus.

Moreover, such an improved fitness apparatus may also provide better ergonomic positions for the performance of certain exercise movements performed with traditional resistance-based fitness apparatuses.

For example, a traditional weighted back squat performed with a barbell requires the user to place the barbell across the upper portion of his or her back/base of his or her neck with the remainder of the barbell extending out in rigid form beyond the width of his or her shoulders. In contrast, the subsections of the improved fitness apparatus may be made to be freely moving—by, for example, leaving the subsections of the apparatus in a freely moving configuration, thereby enabling the apparatus to take on some of the movement and flexibility characteristics similar to those of the interlocked links of a chain—so that the central subsection(s) of the apparatus may be draped across the upper back/base of the neck of the user with the end subsections of the apparatus draping across the tops of the user's shoulders in front of the user, down towards the user's waist. This may allow the user to perform the weighted back squat movement in a safer and more advantageous ergonomic position with the improved apparatus for resistance-based training, and may also allow the user to perform the weighted back squat in a smaller area than is needed when using a barbell.

Another example is the overhead squat traditionally performed using a barbell. By configuring the improved resistance-based fitness apparatus in a linear shape and leaving the central subsection(s) in a freely moving configuration while immobilizing the outer subsections in fixed form, the improved apparatus will then maintain rigid form at the outer subsections while possessing a flexible central subsection(s). The user may use this configuration to perform the overhead squat using form that places less stress and/or strain on the user's shoulders because the user may not then be required to perform the overhead squat movement maintaining the strict shoulder position that is typically required while the weight is pressed overhead when using a barbell. The improved resistance-based fitness apparatus may therefore enable those users who are unable to safely, effectively and comfortably maintain proper shoulder position using a barbell to instead perform the overhead squat using the improved resistance-based fitness apparatus in a safe, effective and comfortable position.

There is a multitude of workout movements that may be performed with the improved resistance-based fitness apparatus where the user may greatly benefit from the ability to configure the apparatus into multiple temporary yet stable shapes with subsections that are freely moving, locked in a fixed position or a combination thereof.

Because the subsection(s) of such an improved resistance-based fitness apparatus may be folded onto each other or otherwise configured into a smaller shape than when the apparatus is fully extended, the improved resistance-based fitness apparatus may be stored in smaller spaces than equivalent sized traditional resistance-based fitness apparatuses and may also be more easily transported than traditional resistance-based fitness training apparatuses by, for example, configuring the improved apparatus into a compact shape to fit into a backpack or other smaller sized carrying bag.

An improved resistance-based fitness training apparatus with the ability to transform into multiple stable yet temporary shapes and configurations (with subsections that could be made to be either freely moving or locked in a fixed position, or a combination thereof) may be constructed with an improved joint-based link connector that may connect one or more objects while also providing for three-dimensional, non-co-planar movement that may be selectively locked or unlocked at a variety of angles in more than one plane by a single activating action (e.g., pressing a button). This configuration is desired because traditional joint-based linked connectors are limited in their ability to be configured into improved resistance-based fitness apparatus with the ability to transform into multiple shapes and configurations. This is because there is no way for traditional joint-based connectors to be selectively secured or unsecured in non-coplanar directions and also made temporarily mobile or immobile with respect to each other using a single locking mechanism. The same drawbacks exist for traditional joint-based linked connectors in other arts. An improved single locking mechanism is thus desired because this allows the user to quickly and easily enable three-dimensional, non-coplanar movement by disengaging the locking mechanism and it also allows the user to quickly and easily immobilize the structure connected to the joint in a fixed position by activating the locking mechanism—all in a single action (e.g. pressing a button).

Accordingly, there is a need for a resistance-based fitness apparatus with the capability of transforming into multiple shapes and configurations (with subsections that could be made to be either freely moving or locked in a fixed position, or a combination thereof).

There is also the need for a joint that can connect one or more objects while also providing for three-dimensional, non-co-planar movement that may be selectively locked or unlocked at a variety of angles in more than one plane by a single activating action (e.g., pressing a button), which may be used to configure an improved resistance-based fitness apparatus and/or which also may be used in various other arts, such as to configure a mechanical tool with at least one subsection that can move and lock in planes of direction—i.e., three-dimensional, non-coplanar—that traditional mechanical tools are unable to move and lock in by single activation action.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

The following numbers correspond to portions of the figures discussed herein.

| | |
|---|---|
| 10 | Improved Linked Oval Chain in Locked, Straight Formation |
| 20 | Improved Linked Oval Chain in Locked, Curved Formation |
| 22 | Improved Linked Solid Chain in Locked, Straight Formation |
| 24 | Improved Linked Square Chain in Locked, Straight Formation |
| 25 | Improved Linked Oval Chain in Unlocked Formation |
| 28 | Portion of Improved Linked Oval Chain in Unlocked Formation |
| 29 | Schematic of Three-Dimensional Diagram Showing Potential Movement of Unlocked Chain |
| 30 | Cutaway of Unlocked Sprocket Joint: Front Perspective View |
| 35 | Cutaway of Unlocked Sprocket Joint: Rear Perspective View |
| 40 | Cutaway of Locked Sprocket Joint: Front Perspective View |
| 45 | Cutaway of Locked Sprocket Joint: Rear Perspective View |
| 70 | Cutaway of Unlocked Rotator Join with Joint Rotating: Front Perspective View |
| 71 | Cutaway of Unlocked Rotator Joint: Front Perspective View |
| 72 | Cutaway of Locked Rotator Joint: Front Perspective View |
| 74 | Cutaway of Locked Rotator Joint: Rear Perspective View |
| 76 | Cutaway of Unlocked Rotator Joint: Rear Perspective View |
| 110 | Link A |
| 120 | Link B |
| 130 | Link C |
| 140 | Link D |
| 150 | Link E |
| 160 | Link F |
| 170 | Link G |
| 172 | Connector A |
| 174 | Connector B |
| 176 | Connector C |
| 178 | Connector D |
| 180 | Connector E |
| 182 | Connector F |
| 184 | Connector G |
| 186 | Connector H |
| 188 | Connector I |
| 210 | Joint AB |
| 220 | Joint BC |
| 230 | Joint CD |
| 240 | Joint DE |
| 250 | Joint EF |
| 260 | Joint FG |
| 270 | Joint GH |
| 280 | Joint HI |
| 310 | Sprocket Joint Casing |
| 320 | Pusher Lever 1 |
| 330 | Pusher Lever 2 |
| 340 | Distal Sprocket 1 Holder |
| 350 | Proximal Sprocket 1 Holder |
| 360 | Sprocket 1 |
| 370 | Distal Sprocket 2 Holder |
| 380 | Proximal Sprocket 2 Holder |
| 390 | Sprocket 2 |
| 400 | Sprocket Lock 1 |
| 410 | Sprocket Lock 2 |
| 420 | Sprocket Locking Button |
| 430 | Sprocket Unlocking Button |
| 440 | Sprocket Actuator |
| 500 | Square Link A |
| 510 | Square Link B |
| 520 | Square Link C |
| 530 | Square Joint AB |
| 540 | Square Joint Locking Button AB |
| 550 | Square Joint BC |
| 560 | Square Joint Locking Button BC |
| 600 | Rotator Joint Casing |
| 610 | Stopper 2 |
| 620 | Rotator Joint 2 |
| 630 | Rotator Actuator |
| 640 | Stopper 1 |
| 650 | Rotator Locking Button |
| 655 | Rotator Unlocking Button |
| 660 | Rotator Joint 1 |
| 1010 | Up/Down Z-Axis |
| 1020 | Left/Right X-Axis |
| 1030 | Front/Back Y-Axis |
| 1040 | Pitch Rotation About X-Axis |
| 1050 | Roll Rotation About Y-Axis |
| 1060 | Yaw Rotation About Z-Axis |

Figure 1A:
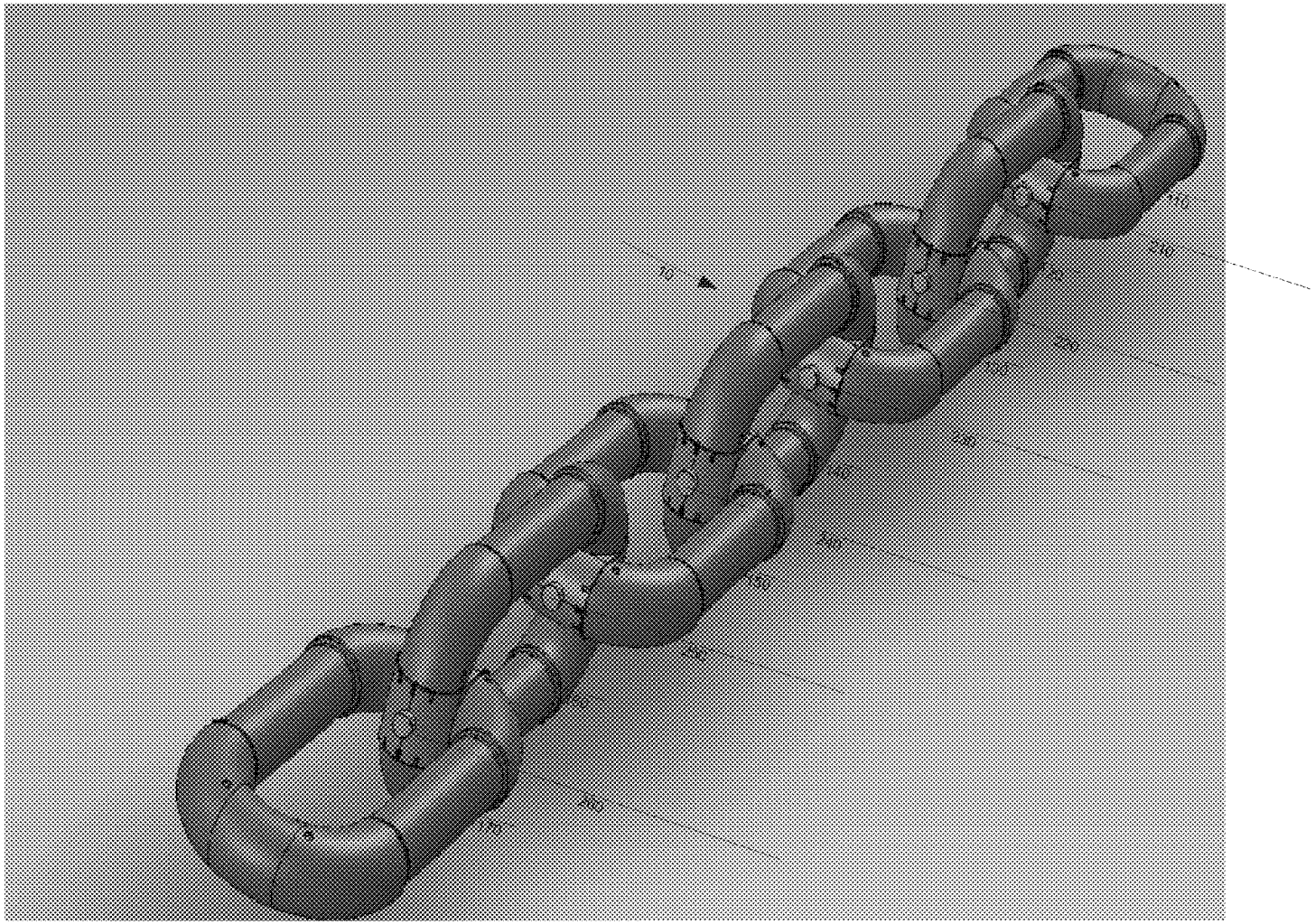

FIG. 1A is a system diagram of an improved linked chain having open oval links in a locked, straight formation, in accordance with some embodiments.

Figure 1B:
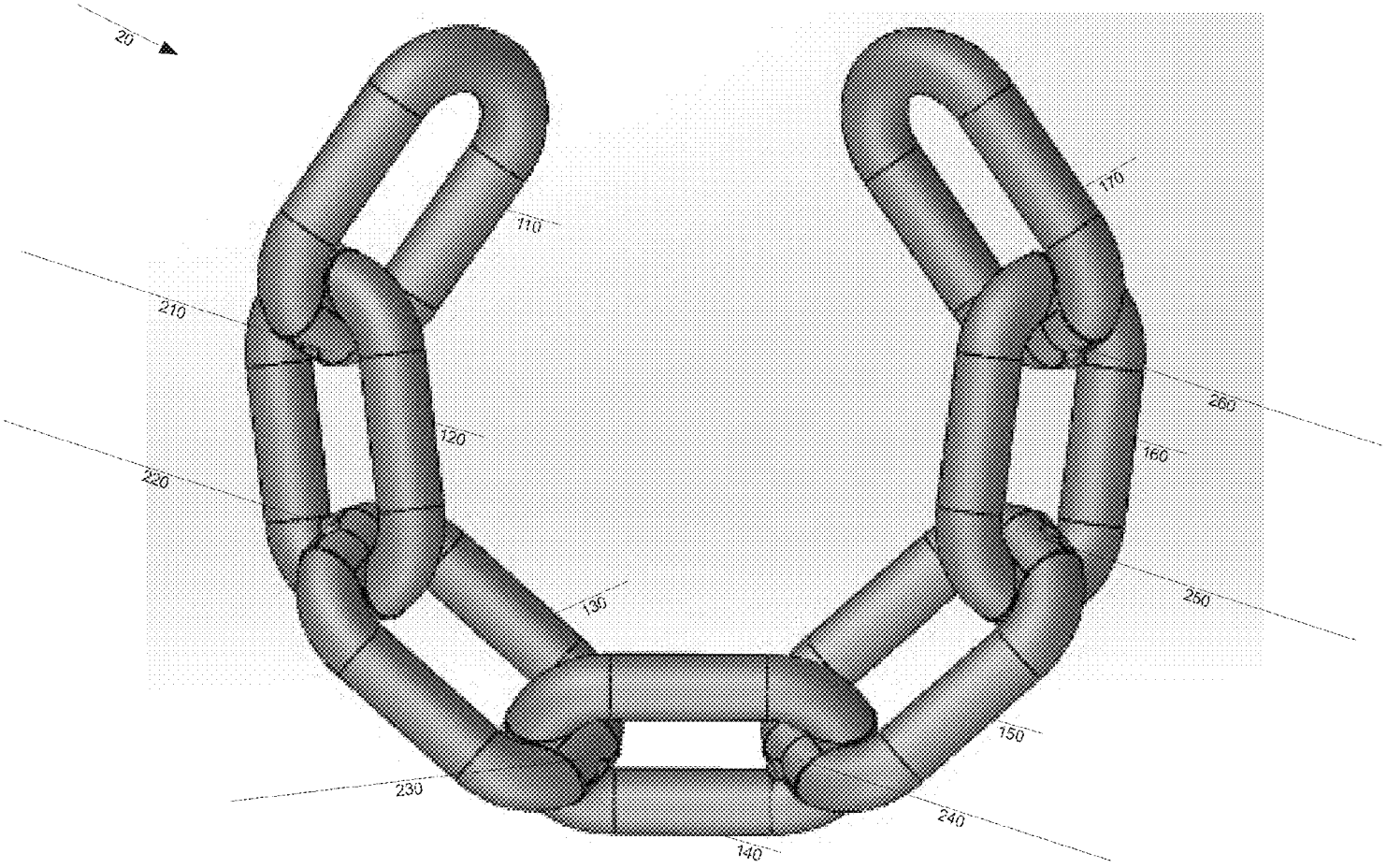

FIG. 1B is a system diagram of an improved linked chain having open oval links in a locked, curved formation, in accordance with some embodiments.

Figure 1C:
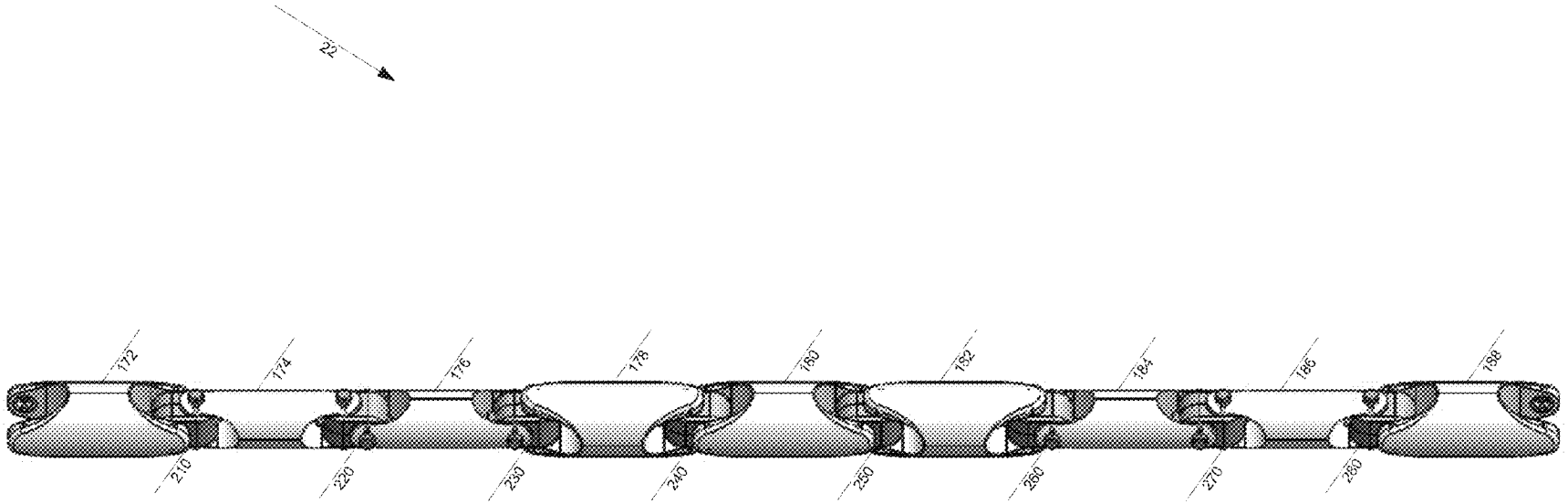

FIG. 1C is a system diagram of an improved linked connector system having closed links in a locked, straight formation, in accordance with some embodiments.

Figure 1D:
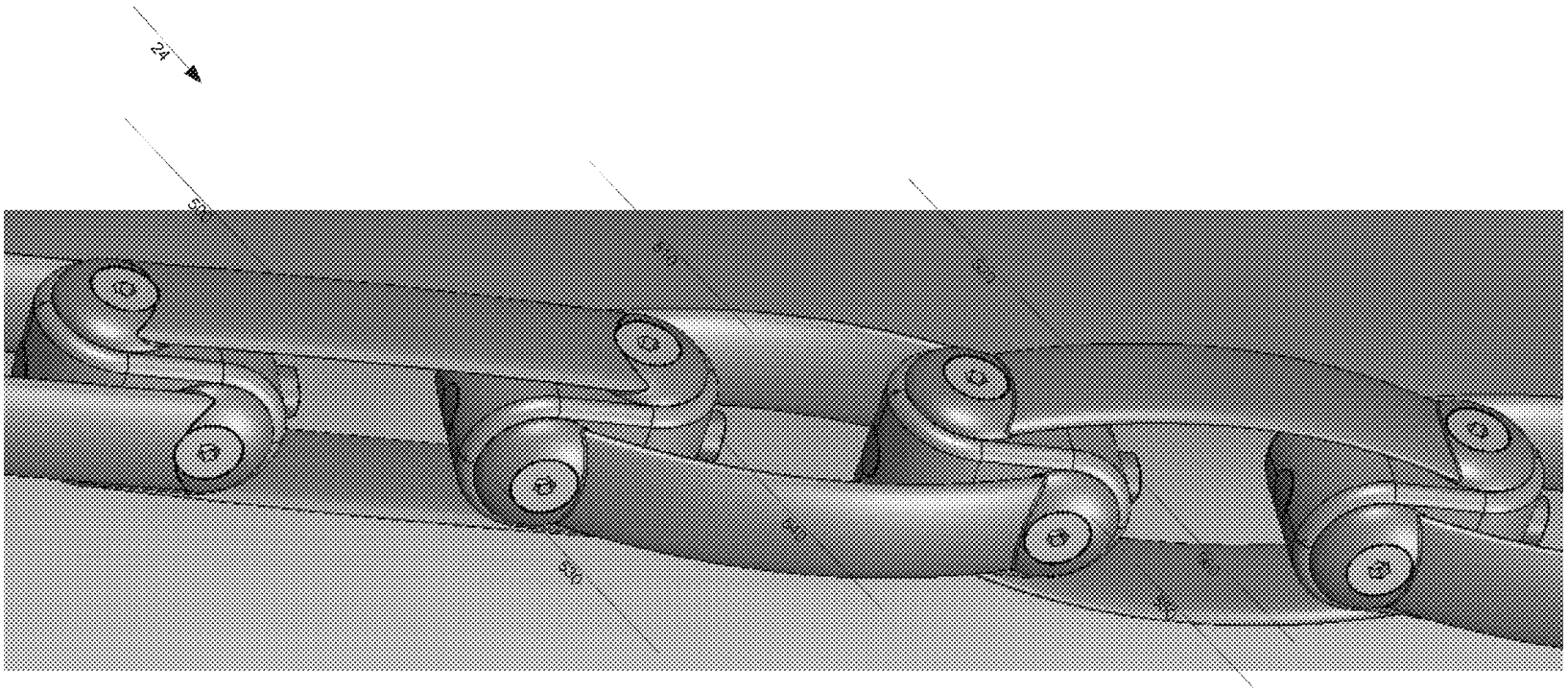

FIG. 1D is a system diagram of an improved linked connector system having open square links in a locked, straight formation, in accordance with some embodiments.

Figure 2A:
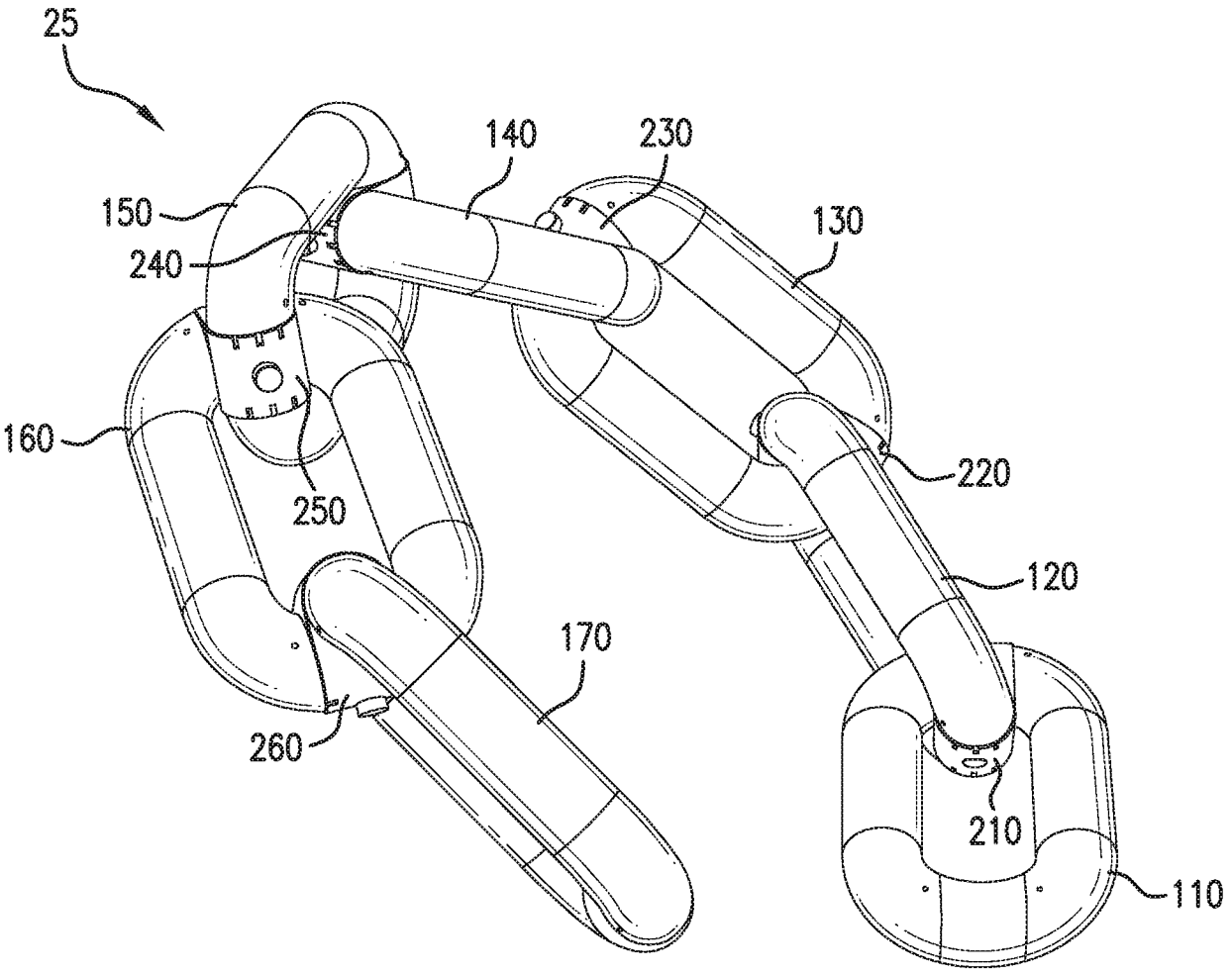

FIG. 2A is a system diagram of an improved linked chain in an unlocked formation, in accordance with some embodiments.

Figure 2B:
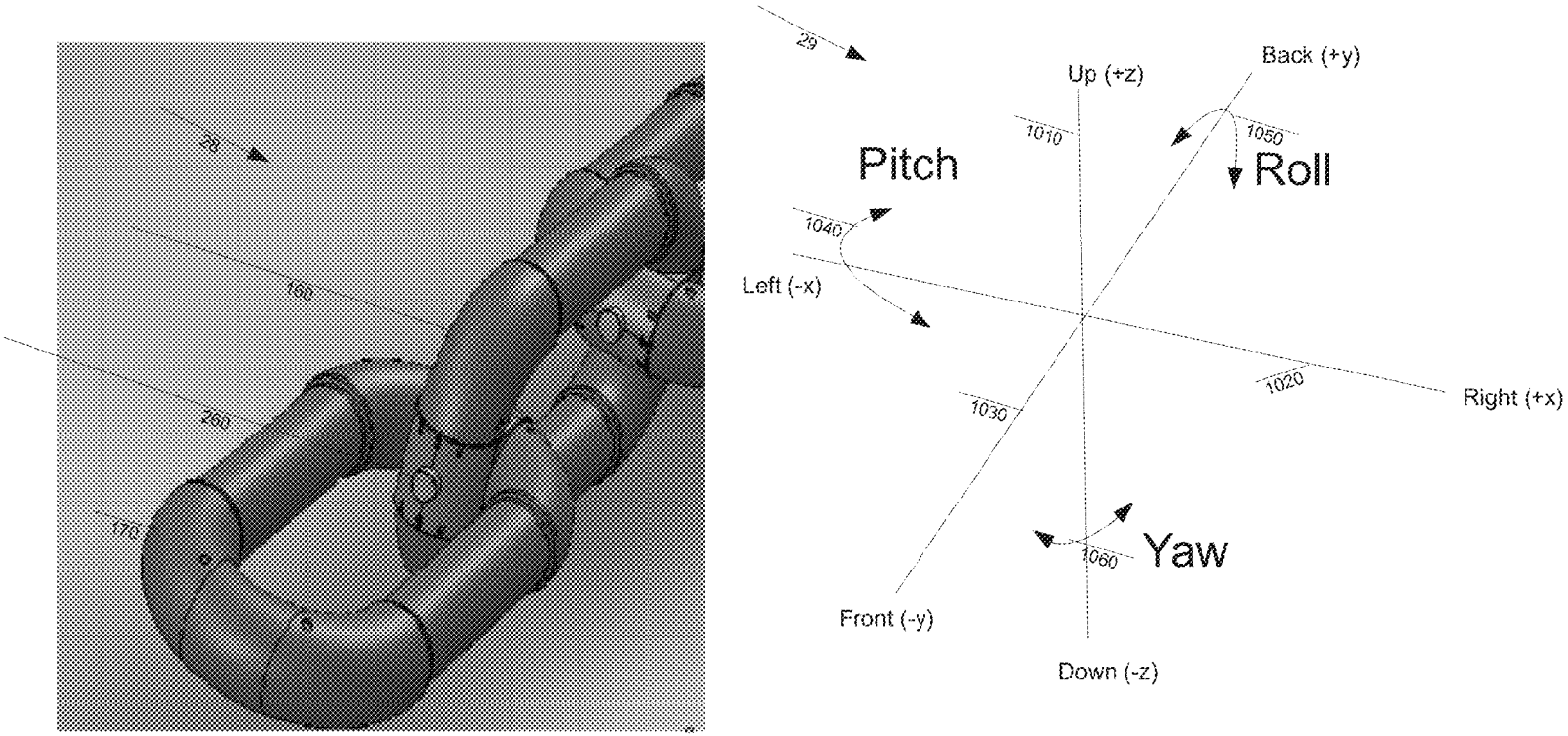

FIG. 2B is an inset of an improved linked chain in an unlocked formation along with a schematic diagram to illustrate the potential three-dimensional movements of the improved linked chain, in accordance with some embodiments.

Figure 3B:
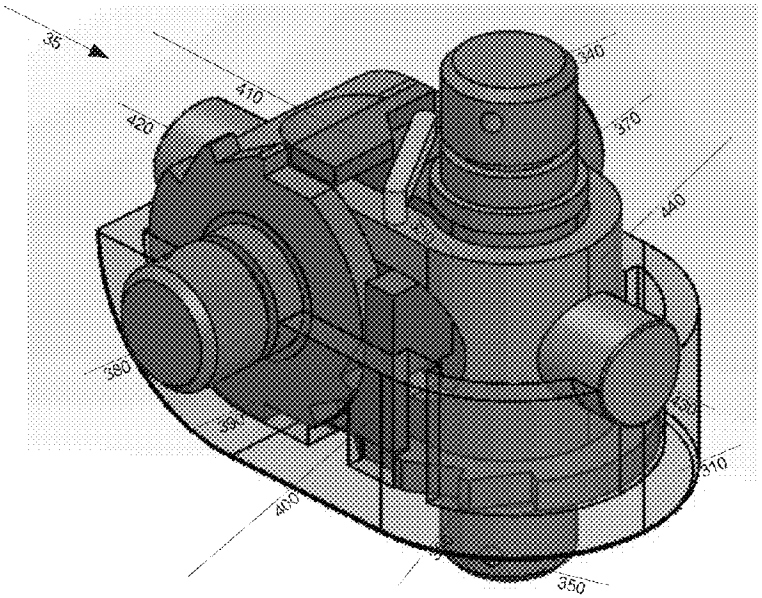
Figure 3A:
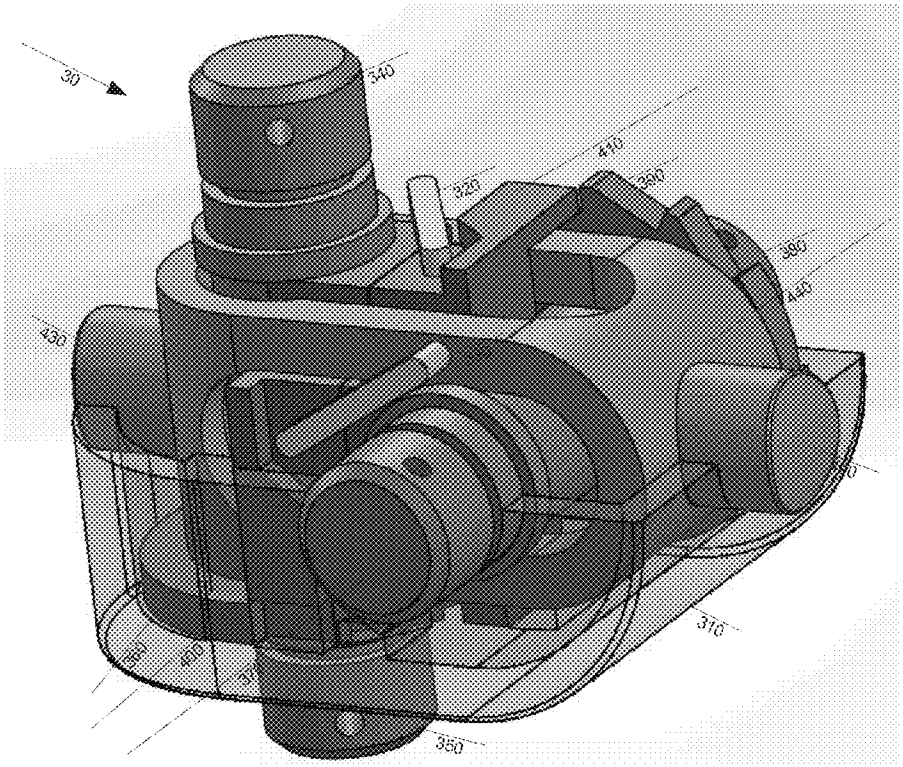

FIG. 3A is a cutaway diagram of an unlocked sprocket joint of an improved linked connector from a front perspective view in accordance with some embodiments.

FIG. 3B is a cutaway diagram of the same unlocked sprocket joint of an improved linked connector as in FIG. 3A except from a rear perspective view, in accordance with some embodiments.

Figure 4B:
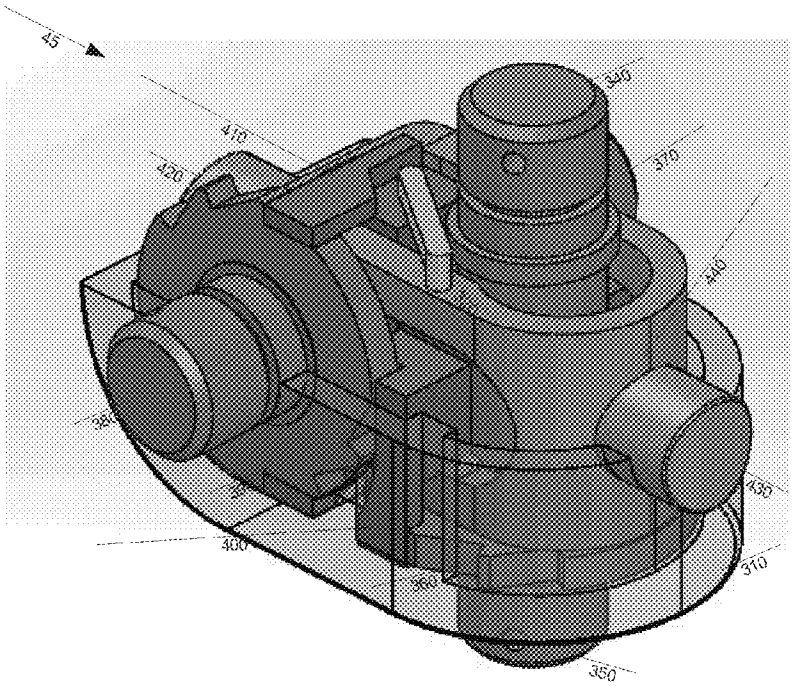
Figure 4A:
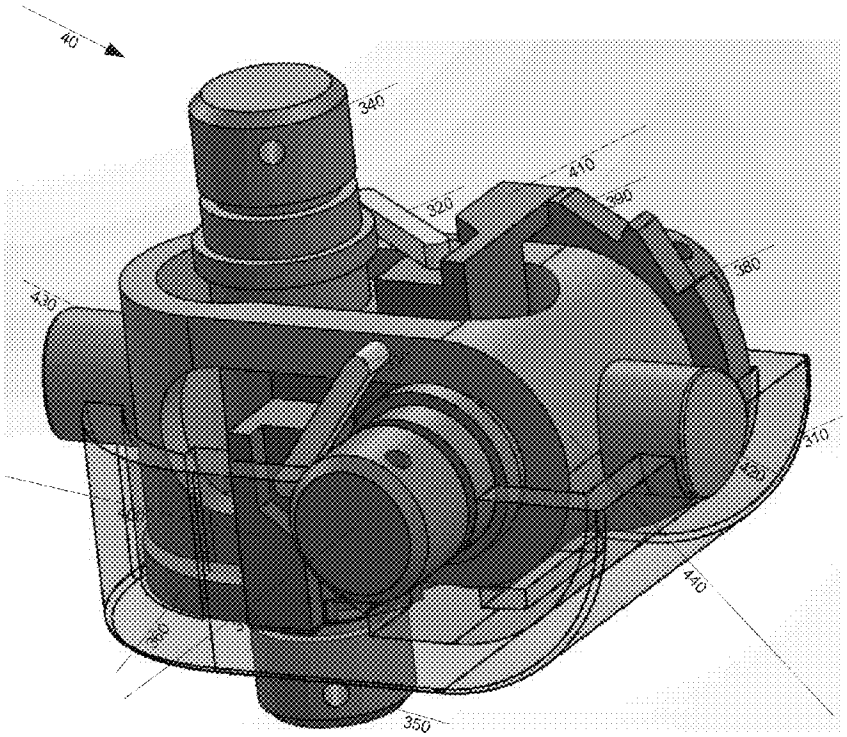

FIG. 4A is a cutaway diagram of a locked sprocket joint of an improved linked connector from a front perspective view, in accordance with some embodiments.

FIG. 4B is a cutaway diagram of the same locked sprocket joint of an improved linked connector as in FIG. 4A except from a rear perspective view, in accordance with some embodiments.

Figure 5:
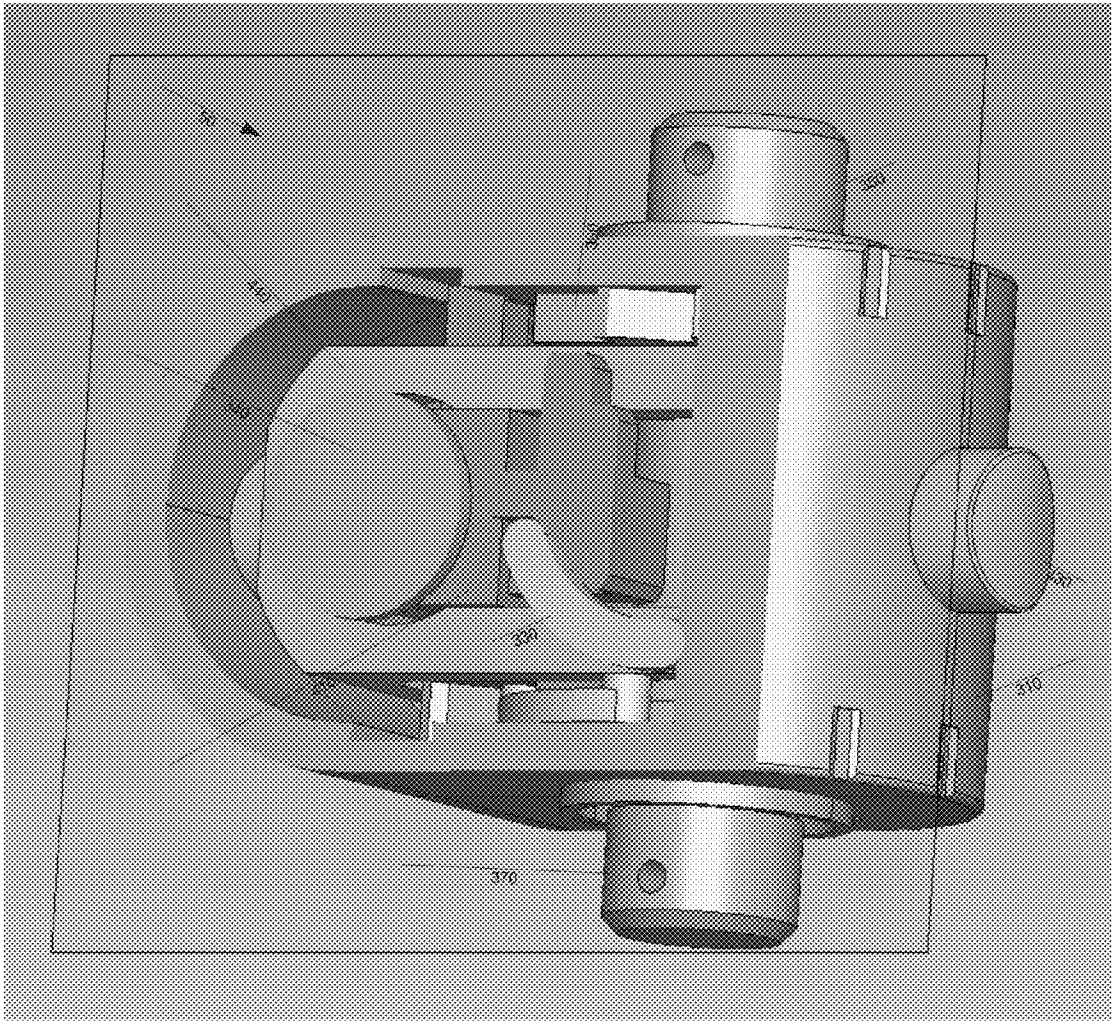

FIG. 5 is a cross-section overhead view of a locked sprocket joint of an improved linked connector, in accordance with some embodiments.

Figure 6A:
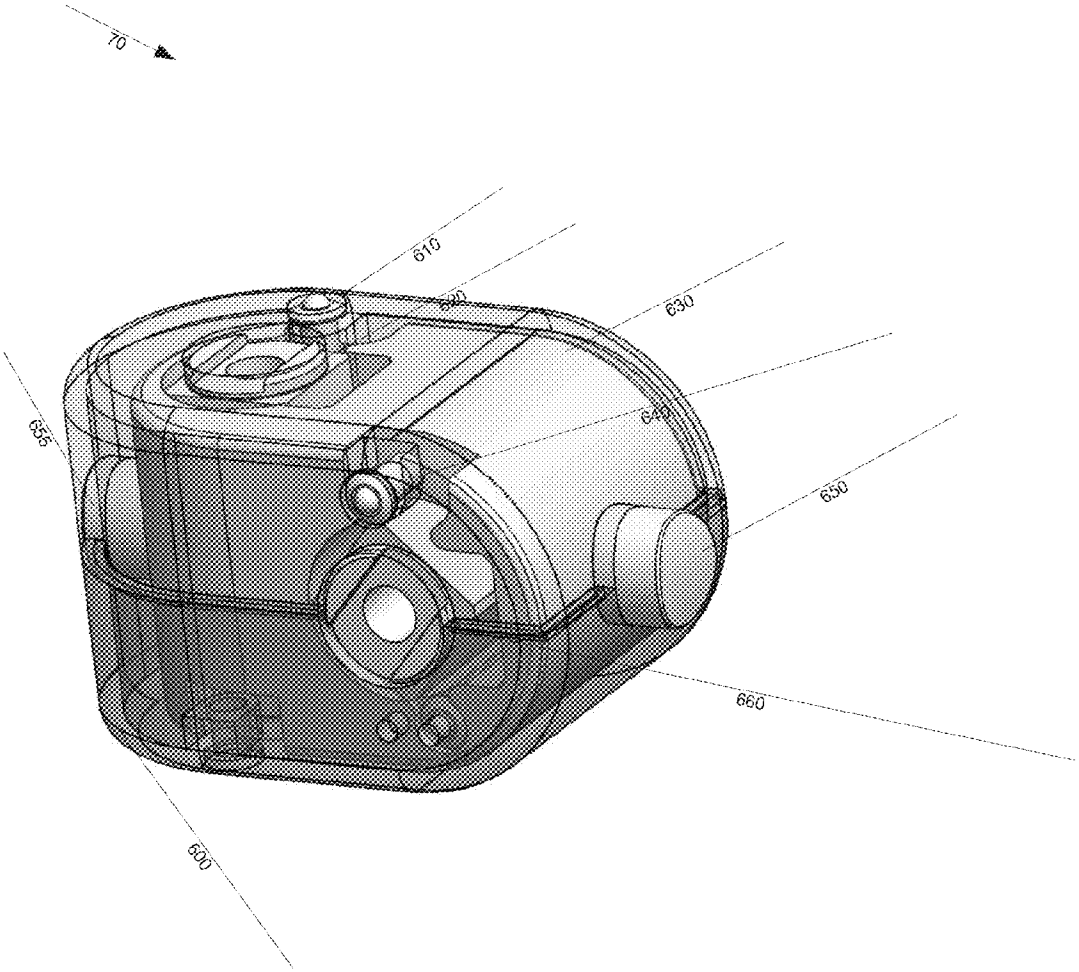

FIG. 6A is a cutaway diagram of an unlocked rotator joint engaged in the act of rotating in an improved linked connector from a front perspective view, in accordance with some embodiments.

Figure 6C:
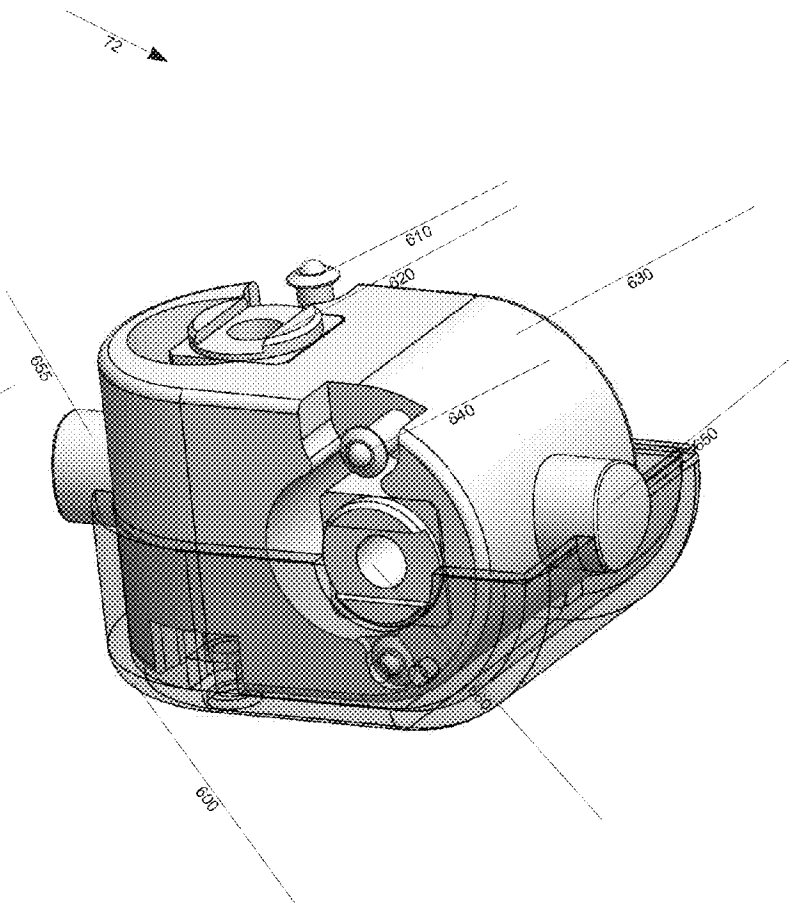
Figure 6B:
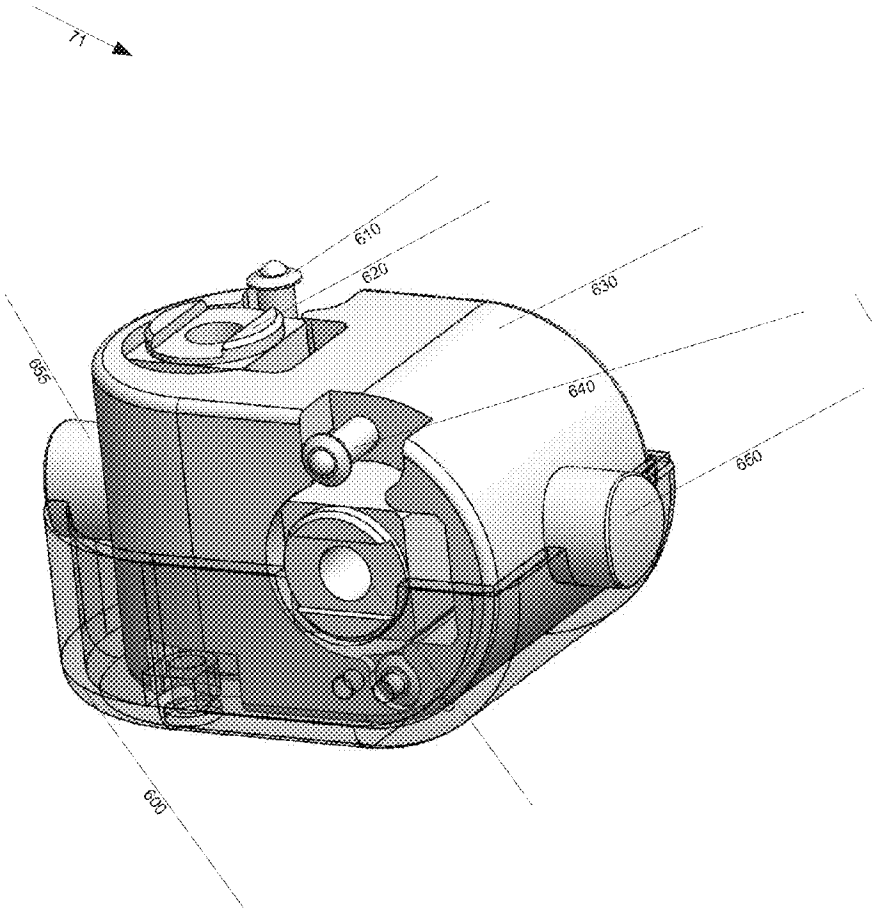

FIG. 6B is a cutaway diagram of an unlocked rotator joint not engaged in the act of rotating in an improved linked connector from a front perspective view, in accordance with some embodiments.

FIG. 6C is a cutaway diagram of a locked rotator joint in an improved linked connector from a front perspective view, in accordance with some embodiments.

Figure 6E:
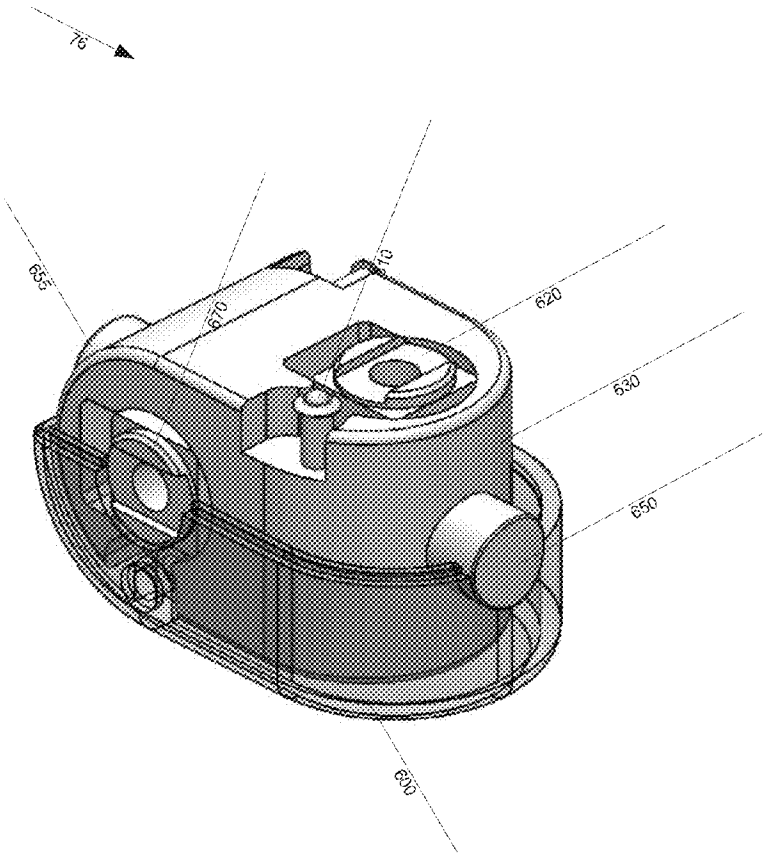
Figure 6D:
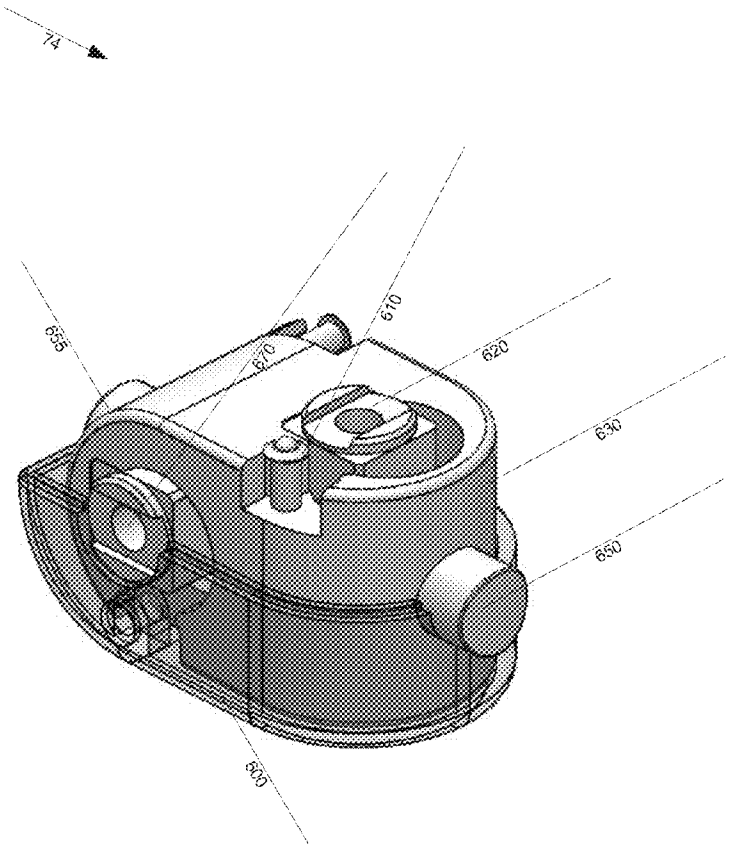

FIG. 6D is a cutaway diagram of the same locked joint of an improved linked connector as in FIG. 6C except from a rear perspective view, in accordance with some embodiments.

FIG. 6E is a cutaway diagram of the same unlocked joint of an improved linked connector as in FIG. 6B except from a rear perspective view, in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

The improved resistance-based fitness training apparatus described herein allows for a user to manipulate the shape of the apparatus and lock the apparatus into a variety of fixed positions and to also manipulate the mobility and rigidity of some or all of the apparatus's subsections, such that the apparatus can be transformed from a lax structure with free movement (such as the links of a chain) to an immobile rigid structure (such as that of a barbell) and to also be manipulated in various different shapes (such as that of a square or circle like shape). The joints and joint-based connectors described herein allow for the resistance-based fitness training apparatus to be transformed into multiple temporary yet stable configurations by connecting one or more objects while providing for three-dimensional movement in non-coplanar directions. The joints may be selectively locked or unlocked at a variety of angles in non-co planar directions by a single activating action. In addition, when locked, the joint prevents any radial movement between the two links it joins in addition to preventing slippage between the links. When unlocked, the joint allows radial movement between the links it joins while preventing slippage between the links connected by the joint. The links may be ring-shaped (incorporating an internal hole) or solid-shaped (not incorporating an internal hole).

Turning to FIGS. 1A and 1B, FIG. 1A shows is an improved link chain with oval ring shapes in a straight line 10 with each joint locked so that the joint prevents radial movement between the links it joins. FIG. 1B shows an improved link chain with oval ring-shapes in a curved line 20 with each joint locked so that the joint prevents radial movement between the links it joins.

The improved link chain shown includes seven links in ring shapes: Link A 110, Link B 120, Link C 130, Link D 140, Link E 150, Link F 160 and Link G 170. The seven links are secured by six joints: Joint AB 210, Joint BC 220, Joint CD 230, Joint DE 240, Joint EF 250 and Joint FG 260. In FIG. 1A, the joints are locked such that there is an approximately 180-degree angle between the links attached by the joint. In FIG. 1B, the joints are locked such that there is an approximately 145-degree angle between the links attached by the joint. Since all six joints are locked, the improved link connector will retain its shape until one or more of the joints are unlocked. These shapes are exemplary only; the joints may be locked at various angles. Thus, there are multiple shapes in which the chain can be formed.

Turning to FIG. 1C, shown is an improved linked connector system in a straight line 22 with solid-shapes where each joint locked so that the joint prevents radial movement between the connectors it joins. The improved linked connector shown includes nine connector links: Connector A 172, Connector B 174, Connector C 176, Connector D 178, Connector E 180, Connector F 182, Connector G 184, Connector H 186 and Connector I 188. The nine links are secured by eight joints: Joint AB 210, Joint BC 220, Joint CD 230, Joint DE 240, Joint EF 250, Joint FG 260, Joint GH 270 and Joint HI 280. In FIG. 1C, the joints are locked such that there is an approximately 180-degree angle between the links attached by the joint. In contrast to FIG. 1A, this connector system includes connectors that are solid-shaped and not linked-shaped.

Turning to FIG. 1D, shown is a portion of an improved linked connector system in a straight line 24 having square ring shapes. The improved linked connector shown includes three connector links Square Link A 500, Square Link B 510, Square Link C 520. The three links are secured by two joints Square Joint AB 530 and Square Joint BC 550. Each of the joints includes a locking/unlocking mechanism Square Joint Locking Button AB 540 and Square Joint Locking Button BC 560.

The linked connector may have a greater or fewer number of links and corresponding joints. The linked connector may also optionally be able to add links and joints on an as-needed basis. The linked connector may also optionally add an additional joint to the edge of link that did not previously have a joint (such as Link A 110 or Link G 170) such that the linked connector may form a closed loop shape. The connector may include ring-shaped links as shown in FIG. 1A, solid-shaped links as shown in FIG. 1C, square-shaped links as shown in FIG. 1D, other shapes or a combination of these.

Further, since each joint may be locked individually at an angle of the user's choosing or not locked at all, the improved linked connector may be formed into a multitude of shapes, both within a single plane in two dimensions and in three dimensions. The three-dimensional shapes may take non co-planar configurations. Further, since one or more joints may be unlocked and one or more other joint may be locked, part or parts of the improved linked connector may be rigid with another part or parts may be fluid.

The locking/unlocking mechanisms for the links may be placed anywhere within the joint to allow radial movement among the links without slippage between the links. The connector may include a mechanism to lock or unlock more than one joint at approximately the same time. Or the connector may include a mechanism to lock or unlock some or all joints at approximately the same time. This may be accomplished by mechanical interference within a joint or several joints and may also operate by a connecting cable joining two or more links that creates tension sufficient to lock or unlock each link when activated. Whatever shaped the improved linked connector takes and no matter how may joints are unlocked or locked, the links are secured so that the links will not slip among the connector.

Turning to FIG. 2A, shown is an improved linked connector with oval ring-shapes in an unlocked formation 25 with ring shapes. The improved link connector shown includes seven links: Link A 110, Link B 120, Link C 130, Link D 140, Link E 150, Link F 160 and Link G 170. Links A-G may also be called devices external. The seven links are secured by six unlocked joints: Joint AB 210, Joint BC 220, Joint CD 230, Joint DE 240, Joint EF 250 and Joint FG 260. Since all joints are unlocked, the improved linked connector has a characteristic fluidity.

Turning to FIG. 2B, shown is an inset 28 an improved linked chain in an unlocked formation showing Link G 170, Link F 160 and Joint FG 260. Alongside the inset 28 is a schematic diagram 29 showing a conceptual rendering of movement in three dimensions. Analogizing from terms used in flight dynamics, shown is a 3-axis system: the X-axis 1020 that runs left to right; the Y-axis 1030 that runs front to back; and the Z-axis 1010 that runs from down to up. Movement about each of these axes is shown as pitch 1040, which is rotation about the X-axis; as roll 1050, which is rotation about the Y-axis; and as yaw 1060, which is rotation about the Z-axis.

Turning to FIGS. 3A and 3B, FIG. 3A is a cutaway diagram of an unlocked sprocket joint of an improved sprocket linked connector from a front perspective view 30 in accordance with some embodiments. FIG. 3B is a cutaway diagram of the same sprocket unlocked joint of an improved linked connector as in FIG. 3A except from a rear perspective view 35, in accordance with some embodiments.

The unlocked joint is encased within a sprocket joint casing 310. The unlocking button 430 is engaged within the sprocket joint casing 310 and secures the actuator 440 with the sprocket joint casing 310 into an unlocked position. In this unlocked position, the actuator 440 engages with the pusher lever 1 320 so that it does not engage and push sprocket lock 1 400 into sprocket 1 360. Since the rotation of sprocket 1 360 is not impeded by sprocket lock 1 400, distal sprocket 1 holder 340 and proximal sprocket 1 holder 350, which are mechanically connected to sprocket 1 360, are free to rotate about the center of the sprocket 1 360. This freedom of movement allows a joint that is formed from distal sprocket 1 holder 340 and a joint that is formed from proximal sprocket 1 holder 350 to rotate freely without causing slipping between links among the connector. Distal sprocket 1 holder 340 and proximal sprocket 1 holder 350 may be called a rotator. Distal sprocket 1 holder 340 and proximal sprocket 1 holder 350 may also be called a joint coupling connector.

In the unlocked position, the actuator 440 also engages with the pusher lever 2 330 so that it does not engage and push sprocket lock 2 410 into sprocket 2 390. Since the rotation of sprocket 2 390 is not impeded by sprocket lock 2 410, distal sprocket 2 holder 370 and proximal sprocket 2 holder 380, which are mechanically connected to sprocket 2 390, are free to rotate about the center of the sprocket 2 390. This freedom of movement allows a joint that is formed from distal sprocket 2 holder 370 and a joint that is formed from proximal sprocket 2 holder 380 to rotate freely without causing slipping between links among the connector. The sprocket 1 360 and sprocket 2 390 may be orthogonal to each other. Distal sprocket 2 holder 370 and proximal sprocket 2 holder 380 may be called a rotator. Distal sprocket 2 holder 370 and proximal sprocket 2 holder 380 may also be called a joint coupling connector. Sprocket 1 360 and sprocket 2 390 may each be called a rotator securing mechanism.

Turning to FIGS. 4A and 4B, FIG. 4A is a cutaway diagram of a locked joint of an improved linked connector from a front perspective view 40 in accordance with some embodiments. FIG. 4B is a cutaway diagram of the same locked joint of an improved linked connector as in FIG. 4A except from a rear perspective view 45, in accordance with some embodiments.

The locked joint is encased within a sprocket joint casing 310. The locking button 440 is engaged within the sprocket joint casing 310 and secures the actuator 440 with the sprocket joint casing 310 into a locked position. In this locked position, the actuator 440 engages with the pusher lever 1 320 so that it engages with and pushes sprocket lock 1 400 into the teeth of sprocket 1 360. When the sprocket lock 1 400 is engaged with the teeth of sprocket 1 360, distal sprocket 1 holder 340 and proximal sprocket 1 holder 350 (which are mechanically connected to sprocket 1 360) cannot rotate about the center of the sprocket 1 360. This means that a joint that is formed from distal sprocket 1 holder 340 and a joint that is formed from proximal sprocket 1 holder 350 cannot rotate freely and will be held in place at an angle depending on where the sprocket lock 1 400 is engaged within the teeth of sprocket 1 360.

In the locked position, the actuator 440 also engages with the pusher lever 2 330 so that it engages with and pushes sprocket lock 2 410 into the teeth of sprocket 2 390. When the sprocket lock 2 410 is engaged with the teeth of sprocket

2 390, distal sprocket 2 holder 370 and proximal sprocket 2 holder 380 (which are mechanically connected to sprocket 1 390) cannot rotate about the center of the sprocket 2 390. This means that a joint that is formed from distal sprocket 2 holder 370 and a joint that is formed from proximal sprocket 2 holder 380 cannot rotate freely and will be held in place at an angle depending on where the sprocket lock 2 390 is engaged within the teeth of sprocket 2 390. The joint that is formed from the sprocket lock 1 400 and distal sprocket 2 holder 370 and the joint that is formed from sprocket lock 2 410 and proximal sprocket 2 holder 380 may be called a joint mechanism. The pusher lever 1 320. pusher lever 2 330, sprocket lock 1 400 and sprocket lock 2 410 may be called a locking device. Sprocket lock 1 400 and sprocket lock 2 410 may each be called a rotator securing mechanism.

In addition to using sprocket teeth and a sprocket lock, there are many other ways to create the necessary form of mechanical interference within the joint to lock each link (for example: gears, keyhole/tongue and groove, a common cables running through each link, etc.).

Turning to FIG. 5 shown is a cross-section overhead view of a locked joint 50, in accordance with some embodiments. The locked joint is encased in a sprocket joint casing 310. The unlocking button 430 protrudes from the sprocket joint casing 310 (which means that the joint is in locked mode). In the locked position, the actuator 440 engages with the pusher lever 2 330 so that it engages with and pushes sprocket lock 2 410 into the teeth of sprocket 2 390. When the sprocket lock 2 410 is engaged with the teeth of sprocket lock 2 390, distal sprocket 2 holder 370 and proximal sprocket lock 2 holder 380 (which are mechanically connected to sprocket 1 390) cannot rotate about the center of the sprocket lock 2 390. This means that a joint that is formed from distal sprocket lock 2 holder 370 and a joint that is formed from proximal sprocket lock 2 holder 380 cannot rotate freely and will be held in place at an angle depending on where the sprocket lock 2 390 is engaged within the teeth of sprocket lock 2 390.

The joint casing may be made of any material that secure the joints parts within the sprocket joint casing 310. The pusher lever 1 320, pusher lever 2 330, distal sprocket holder 1 holder 340, proximal sprocket 1 holder 350, sprocket 360, distal sprocket holder 2 holder 370, proximal sprocket lock 2 holder 380, sprocket 2 390, sprocket lock 1 400 and sprocket lock 2 410, locking button 420, unlocking button 430 and actuator 440 may be made of any material that is strong and flexible enough to perform their respective functions. Such material may include, without limitation rubber, plastic, composites, metal or a combination of the foregoing.

Turning to FIGS. 6A through 6E, shown are cutaways diagrams of a different embodiment using a rotator joint instead of a sprocket joint. Shown in FIG. 6A, is a cutaway front perspective view of an unlocked rotator join 70 with the joint in a rotating motion. Shown in FIG. 6B is a cutaway front perspective view of an unlocked rotator joint 71 with the joint not in a rotating motion. Shown in FIG. 6C is a cutaway front perspective view of a locked rotator joint 72. Shown in FIG. 6D is a cutaway rear perspective view of a locked rotator joint 74. Shown in FIG. 6E is a cutaway rear perspective view of an unlocked rotator joint 76.

The rotator joint is encased in a rotator joint casing 600. In an unlocked position, the rotator unlocking button 655 is engaged within the rotator joint casing 600 and is mechanically connected to the rotator actuator 630. The position of the rotator actuator 630 when unlocked allow the rotator joint 1 660 and rotator joint 2 620 to each independently rotate about its cylindrical axis (the axis running in the z direction using cylindrical coordinates ρ, ϕ, z. This freedom of rotation will allow links that are mechanically connected to rotator joint 1 and rotator joint 2 to have freedom of radial movement within the chain without causing slipping between links among the connector. The combination of rotator joint 1 660; rotator joint 2 620, and rotator actuator 630 may be called a joint mechanism. The rotator actuator 630 may be called a locking device. Rotator joint 1 660 may be called a rotator. Rotator joint 2 620 may be called a rotator.

Shown in FIG. 6A is the rotator joint 1 660 in the midst of such freedom of rotation. Also shown in FIG. 6A, the mechanical composition of the rotator joint 1 660 and the rotator actuator 630 do not allow the rotator actuator 630 and rotator joint 1 660 to engage together. Thus, at that point of rotation of the rotator joint 1, the rotator locking button 650, which is mechanically connected to the rotator actuator 630 will be unable to lock the rotator joint. In contrast, as shown in FIG. 6B, the mechanical composition of the rotator joint 1 660 and the rotator actuator 630 allow the rotator actuator 630 and rotator joint 1 660 to engage together. Thus, at that point of rotation of the rotator joint 1, the rotator locking button 650, which is mechanically connected to the rotator actuator 630 will be able to lock the rotator joint casing 600 and engages with the rotator joint 1 660 and rotator joint 2 620. Although the rotator joint 1 660 and rotator joint 2 620 shown are squared, allowing for 4 possibilities for locking, the rotator joint 1 660 and rotator joint 2 620 may be of any shape to all additional possibilities for locking, which will allow for additional possible formations of the improved chain when in a locked position.

The act of locking the rotator joint is accomplished by depressing the rotator locking button 650, which is mechanically engaged to the rotator actuator 630. Within the joint casing 600 are stopper 1 640 and stopper 2 610 that engage with the rotator actuator 630 and ensure that the locking mechanism does not damage the rotator joint 1 660 and rotator joint 2 620. The rotator actuator engages with the rotator joint 1 660 and rotator joint 2 620 so as to impeded their movement about their cylindrical axes. Thus, the links that are mechanically connected to rotator joint 1 660 and rotator joint 2 620 become locked and will not have freedom of radial movement within the chain. As such, rotator joint 1 660 and rotator joint 2 620 may each be called joint coupling connectors. Slipping between links among the connector is also prevented. Stopper 1 640 and stopper 2 610 may each be called a rotator securing mechanism.

The rotator actuator is also mechanically engaged with the rotator unlocking button 655 so that when the joint is locked, the rotator unlocking button 655 juts out from the rotator casing 600 as the rotator locking button 650 becomes flush with the rotator casing 600.

Referring back to the 3-dimensional renderings in FIG. 2B, this rendering will now be referenced as if the improved connector having the dual rotator joint 1 660 and rotator joint 2 620 was arranged in the formation of the improved link formation shown in FIG. 2B 28. When unlocked, the link 170 in the improved linked connector may freely allow rotation in at least two orthogonal degrees of freedom—in the pitch direction 1040 and in the yaw direction 1060. Significant rotation in the roll direction 1050 is limited because there is no joint that facilitates direct rotation in that direction. When the link 170 is rotated in the pitch direction 1060 and/or the yaw direction 1040, some roll direction 1060 rotation is possible as a result of the rotation in the other axes. The same rotation in the same axes is possible if the improved connector having the sprocket 1 360 and sprocket lock 2 390 was arranged in the formation of the improved link formation shown in FIG. 2B 28.

The materials and parts of the improved linked connected may be made of any material that is strong and flexible enough to perform their respective functions. Such material may include, without limitation rubber, plastic, composites, metal or a combination of the foregoing.

The securing of the joints between the links in the improved linked connector allows it be used for many applications that take advantage of the connector's flexibility. Such applications include fitness where the connector can join one or more objects to be used as a weighted device or other resistive device that may take on different user desired shapes and that may be transformed from a rigid structure to a fluid structure.

Another application of the connector includes a weighted apparatus with connecting structures used for fitness or other purposes that may take on different shapes when the user manipulates the connecting structures. This transformable structure is capable of taking on all rigid elements, lax elements, or a combination thereof. In addition, this transformable structure may accommodate additional structures that may be attached to the joined object by various means, including quick release pins, eyebolt attachments or other means to adhesively add or remove the weights. In addition, the user may fashion the connector so as to wrap it around himself or herself to be supported by the shoulders, arms or legs. The connector may then be used as a resistance device for a particular part or parts of the users' body.

As an alternative, the improved linked connector may be anchored to operate in a fulcrum-like manner with three-dimensional movement being possible through the selective locking and unlocking of specific joints.

Another application of the connector includes any use where a rigid bar is needed and minimal storage space is desired. The connector can be folded up into a smaller space making transporting and storing the connector more convenient.

In addition to the fitness field, the connector has multiple applications in the field of mechanical tools, where the ability to lock and unlock a freely moving object may be desired. Because the connector allows the joints to move or be locked in non-co-planar directions, the mechanical tool may be used to create three-dimensional shapes to allow for useful tool designs not presently possible.

In addition, since links will not slip along the connector even when unlocked makes the connector far safer than current chains used in the fitness arts and other mechanical arts.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. An apparatus comprising:

a joint mechanism;

a joint casing enclosing the joint mechanism;

a locking device secured within the joint casing that selectively engages the joint mechanism in a locked mode and in an unlocked mode;

an actuator partially protruding from the joint casing mechanically connected to the locking device;

wherein the joint mechanism comprises at least one joint coupling connector, and wherein each of the at least one joint coupling connector is capable of mechanically engaging with a device external to the joint casing;

and wherein when the joint mechanism is in the unlocked mode, each of the at least one joint coupling connector mechanically allow each of the devices external to the joint casing that is mechanically engaged with each of the at least one joint coupling connector to rotate within three-dimensional space;

and wherein when the joint mechanism is in the locked mode, each of the at least one joint coupling connector prevent each of the devices external to the joint casing that is mechanically engaged with each of the at least one joint coupling connector from substantially deviating from the position in three-dimensional space that each of the devices external to the joint casing that is mechanically engaged with each of the at least one joint coupling connector occupied just prior to the engagement of the joint mechanism in the locked mode;

wherein the at least one joint coupling connector comprise a first joint coupling connector and a second joint coupling connector and wherein the first joint coupling connector and the second joint coupling connector are in substantially orthogonal positions within the joint mechanism;

wherein the rotation of the device external to joint casing that is mechanically engaged with the first joint coupling connector is not co-planar with the rotation of the device external to the joint casing that is mechanically engaged with the second joint coupling connector;

wherein the actuator comprises a locking actuator and an unlocking actuator, and wherein the locking actuator protrudes from the joint casing when the joint mechanism is in the locked mode and wherein the unlocking actuator protrudes from the joint casing when the joint mechanism is in the unlocked mode.

2. The apparatus as in claim 1, wherein the protrusion of the locking actuator and the protrusion of the unlocking actuator are on substantially opposite ends of the joint casing.

3. The apparatus as in claim 2, further comprising at least one stopper preventing contact between a portion of the joint mechanism and a portion of the locking device.

4. A connecting apparatus comprising:

a) a first connector;

b) a second connector; and c) a joint apparatus between the first connector and the second connector, the joint apparatus comprising:

i) a joint casing;

ii) a locking device partially secured within the joint casing that is selectively engageable in a locked mode and in an unlocked mode;

iii) an actuator within the joint casing connected to the locking device;

iv) a first rotator partially secured within the joint casing and capable of axial rotation and secured to the first connector so that axial movement of the first rotator results in rotational movement of the first connector;

v) a first rotator securing mechanism;

vi) a second rotator partially secured within the joint casing and capable of axial rotation and secured to the second connector so that axial movement of the second rotator results in rotational movement of the second connector; and vii) a second rotator securing mechanism;

wherein when the locking device is engaged in the locked mode, the actuator engages with the first rotator securing mechanism to impede axial movement of the first rotator and the actuator engages with the second rotator securing mechanism to impede axial movement of the second rotator;

wherein when the locking device is engaged in the unlocked mode, the actuator engages with the first rotator securing mechanism to permit axial movement of the first rotator and the actuator engages with the second rotator securing mechanism to permit axial movement of the second rotator.

5. The connecting apparatus as in claim 4, wherein the first rotator and the second rotator are substantially orthogonal to each other.

6. The connecting apparatus as in claim 5, wherein the first connector, the second connector and the joint apparatus are portions of a resistance device capable of being utilized in an exercise regimen.

7. The connecting apparatus as in claim 6, wherein the first connector and the second connector each incorporate an internal hole.

8. The connecting apparatus as in claim 7, wherein the first connector and the second connector do not slip between each other because they are secured by the joint apparatus.

* * * * *